US005458551A

United States Patent [19]

Shenton

[11] Patent Number: 5,458,551

[45] Date of Patent: Oct. 17, 1995

[54] REUSABLE BREAKAWAY BOARD ASSEMBLY

[76] Inventor: Craig Shenton, 320 E. Third St. South, Newton, Iowa 50208

[21] Appl. No.: 353,912

[22] Filed: Dec. 12, 1994

[51] Int. Cl.[6] ..... A63B 69/00

[52] U.S. Cl. ..... 482/83

[58] Field of Search ..... 273/440, 380, 273/390–392; 482/83, 84

[56] References Cited

U.S. PATENT DOCUMENTS

| | | | |
|---|---|---|---|
| 1,479,007 | 1/1924 | Pedersen | 292/80 |
| 1,544,827 | 7/1925 | French . | |
| 3,973,772 | 8/1976 | Milliken | 272/76 |
| 4,004,799 | 1/1977 | Kundert | 272/8 N |
| 4,068,872 | 1/1978 | Smith | 292/87 |
| 4,171,803 | 10/1979 | Smith | 272/76 |
| 4,261,479 | 4/1981 | Caserta | 220/326 |
| 4,295,646 | 10/1981 | Squire | 272/76 |
| 4,365,800 | 12/1982 | Hay et al. | 272/76 |
| 4,491,316 | 1/1985 | Prince | 482/83 X |
| 4,572,504 | 2/1986 | DiBartolo | 482/83 |
| 4,583,730 | 4/1986 | Gecht et al. | 272/76 |
| 4,757,989 | 7/1988 | Bauer, Jr. | 482/83 |
| 4,889,334 | 12/1989 | Partlo | 482/83 |
| 4,932,652 | 6/1990 | Beall, III | 272/76 |
| 5,131,896 | 7/1992 | Hutchings | 482/83 |
| 5,183,451 | 2/1993 | Hautamaki | 482/86 |
| 5,196,249 | 3/1993 | Svehaug | 428/60 |
| 5,362,289 | 11/1994 | Holt | 482/83 |

FOREIGN PATENT DOCUMENTS

| | | |
|---|---|---|
| 1420471 | 11/1965 | France . |
| 1736529A | 5/1992 | U.S.S.R. . |
| 2032289 | 5/1980 | United Kingdom . |

*Primary Examiner*—Paul E. Shapiro

*Attorney, Agent, or Firm*—Zarley, McKee, Thomte, Voorhees & Sease

[57] ABSTRACT

A reusable breakaway board assembly for simulating the breaking of boards includes two boards supported in a coplanar position by support members and a latching mechanism. When a sufficient force is applied for the boards the deflection of a third board causes the latching mechanism to unlatch which in turn causes the two boards to collapse.

11 Claims, 5 Drawing Sheets

6-6

REUSABLE BREAKAWAY BOARD ASSEMBLY

BACKGROUND OF THE INVENTION

The present invention relates to a reusable breakaway board assembly, and in particular to a reusable martial arts training board which simulates breaking real boards.

Martial arts practitioners sometimes break wooden boards in their training in order to develop or demonstrate hand and foot strikes. The boards are supported on their edges and struck by the hand or foot. If the strike is forcible enough, the board will break in two. In the prior art, boards are broken and usually discarded, creating substantial cost and waste. As a result, the practice of karate can become expensive and wasteful.

Various devices have been developed in the past to simulate the breaking of boards without having the cost of the boards and the waste products. Most of the prior art devices include two striking boards made from wood or plastic attached together using some type of fastener. When the boards are struck with a sufficient force, the fastener unfastens and the two boards are separated. However, these prior art devices can wear through time and use resulting in a weaker fastening of the boards which then requires less force to break apart. Also, these types of devices do not simulate the actual breaking of a board. Some other prior art devices are fastened by parts that are severed during the breakage and these parts must be discarded and replaced.

Therefore, a primary object of the present invention is the provision of a reusable breakaway board assembly.

A further object of the present invention is the provision of a reusable breakaway board assembly which more closely simulates the real conditions incurred in breaking boards.

A further object of the present invention is the provision of a reusable breakaway board assembly that can be adjusted to simulate the breaking of one board or a plurality of boards.

A further object of the present invention is the provision of a reusable breakaway board assembly that produces less waste and less cost.

A further object of the present invention is the provision of a reusable breakaway board assembly that uses a breaking mechanism which closely simulates the conditions required for the breaking of a real board.

A further object of the present invention is the provision of a reusable breakaway board assembly which can be self-supporting, eliminating the need of a second person to hold a device.

A further object of the present invention is the provision of a reusable breakaway board assembly which is simple in construction, easy to manufacture, and reliable in operation.

SUMMARY OF THE INVENTION

The reusable breakaway board assembly of the present invention is a device used for martial arts or karate practice. The invention comprises a base with two pairs of opposing support members extending perpendicularly from the base. Attached to each pair of support members opposite the base is a board. One end of each board is attached to the support member by a hinge. The boards are each movable between a first, horizontal position, where the ends of the two boards are adjacent to and abut each other, and a second position where the boards swing downward and are generally parallel to the support members. Attached to the underside of one of the boards and extending along the length of the two boards ill the first horizontal position is a horizontal resistance piece. Attached to the underside of the resistance piece is a breakaway piece. The resistance piece extends slightly farther than the breakaway piece. A pressure release piece is coupled to the base and extends from the base generally parallel to the support members. Near the end of the pressure release piece opposite the base is a companion piece having a beveled edge. The companion piece is slidably coupled to the pressure release piece. The resistance piece extends to the outer most edge of the pressure release piece and rests on top of it. When pressure is applied to the boards by hitting or kicking the abutted ends of the boards, the resistance piece will bend causing the breakaway piece to slide along the beveled edge of the companion piece and push outwardly the companion piece and pressure release piece until the resistance piece is free from the edge of the pressure release piece. The companion piece may be adjusted up and down by means of a slot and fastener to provide greater resistance or a less resistance. The boards will then swing on their hinges to their second position adjacent to the support members. The assembly can then be reset by moving the boards back to a horizontal position and placing the resistance piece atop the pressure release piece, causing alignment of the beveled edges of the breakaway and companion pieces.

DETAILED DESCRIPTION OF THE PREFERRED EMBODIMENT

Figure 1:
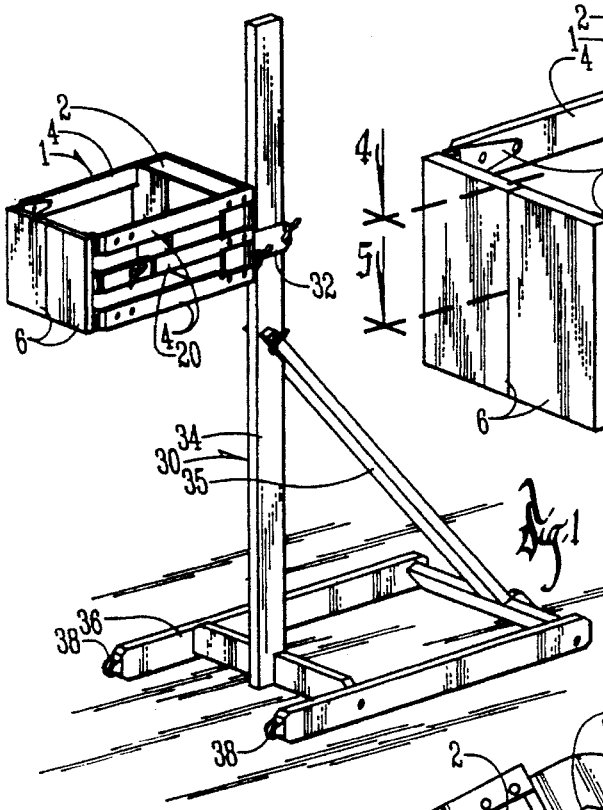
FIG. 1 is a isometric view of the reusable breakaway board assembly.
Figure 2:
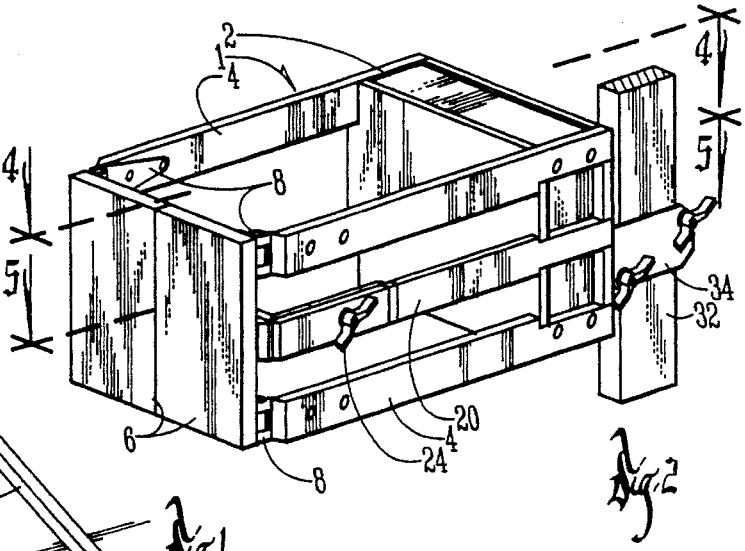
FIG. 2 is an enlarged isometric view.

The present invention will be described as it applies to a preferred embodiment. It is not intended that the present invention be limited to the described embodiment. It is intended that the invention cover all alternatives, modifications, and equivalences which may be included within the spirit and scope of the invention.

Referring to FIGS. 1–14 there is shown a reusable breakaway board assembly 1 supported by stand 30. The assembly 1 comprises a base 2 having two pairs of opposing support members extending perpendicularly from the base. Attached to each pair of opposing support members 4 is a board 6. These first and second boards 6 are attached to the opposing support members 4 by a hinge 8 so that the boards 6 are movable between a first position parallel to the base 2 and perpendicular to the support members 4 and a second position where boards 6 are parallel and along side support members 4. When the two boards 6 are in the first position, the ends of the two boards 6 that are not attached to hinges 8 are near each other in a narrowly abutting, coplanar position. In this first position, the two boards 6 closely resemble a single board much like the ones used by martial art practitioners in practicing karate.

Figure 7:
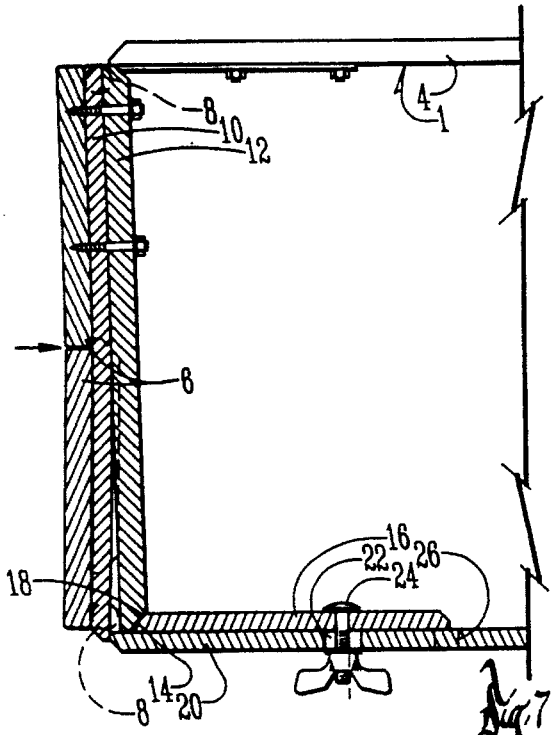
FIGS. 7–9 are enlarged sequential cross-sectional views of FIG. 5.
Figure 8:
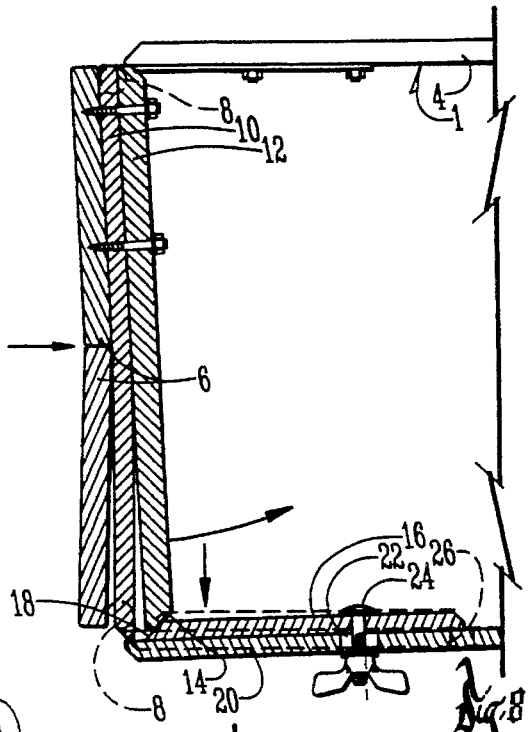
Figure 9:
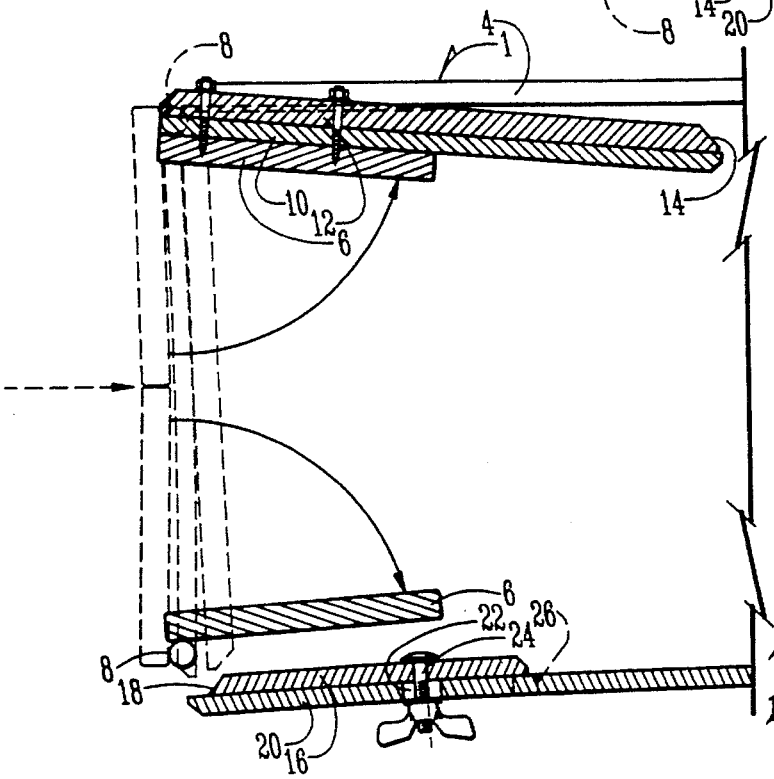

The boards 6 are locked in the first position by a novel latching mechanism. Coupled to the first board 6 is a resistance piece 10. The resistance piece 10 is disposed along both boards 6, when they are in the first position but it is only coupled to the first board 6. Attached at the underside of the resistance piece 10 is a breakaway piece 12. The breakaway piece 12 is coupled to the same board as the resistance piece 10. The breakaway piece 12 also extends along the length of the two boards 6 while in the first position. A pressure release piece 20 is coupled to the base and extends perpendicular to the base generally parallel to the opposing support members 4. The pressure release piece 20 is attached to the side of the base 2 opposite the first board 6. When the boards 6 are in the first position, the end of the resistance piece 10 makes contact with the end of the pressure release piece 20, locking the boards 6 in the first position. A companion piece 16 is slidably coupled to the pressure release piece 20. The companion piece has a beveled edge positioned near the end of the pressure release piece 20. When the boards 6 are in the first position, the beveled edge of companion piece 16 is near the end of breakaway piece 12. In the preferred embodiment, the breakaway piece 12 is also beveled. As shown in FIGS. 7 and 8, when a force is applied to the boards 6 by hitting or kicking the abutted ends of the boards 6, the resistance piece 10 will bend causing breakaway piece 12 to move and slide along the beveled edge of companion piece 16. As shown in FIG. 8, this in turn causes companion piece 16 and pressure release piece 20 to move outwardly. When the pressure release piece 20 is moved outward a sufficient distance, the end of resistance piece 10 will no longer make contact with the end of pressure release piece 20. As shown in FIG. 9, at this point the resistance piece 10 is no longer being supported by the pressure release piece 20 so the force will push the boards 6 to the second position parallel to the support members 4.

The assembly 1 can be reset to the first position by moving the boards 6 back to the first position and positioning the resistance piece 10 atop the pressure release piece 20, causing the alignment of the breakaway piece 12 and companion piece 16.

Figures 4, 5, 6:
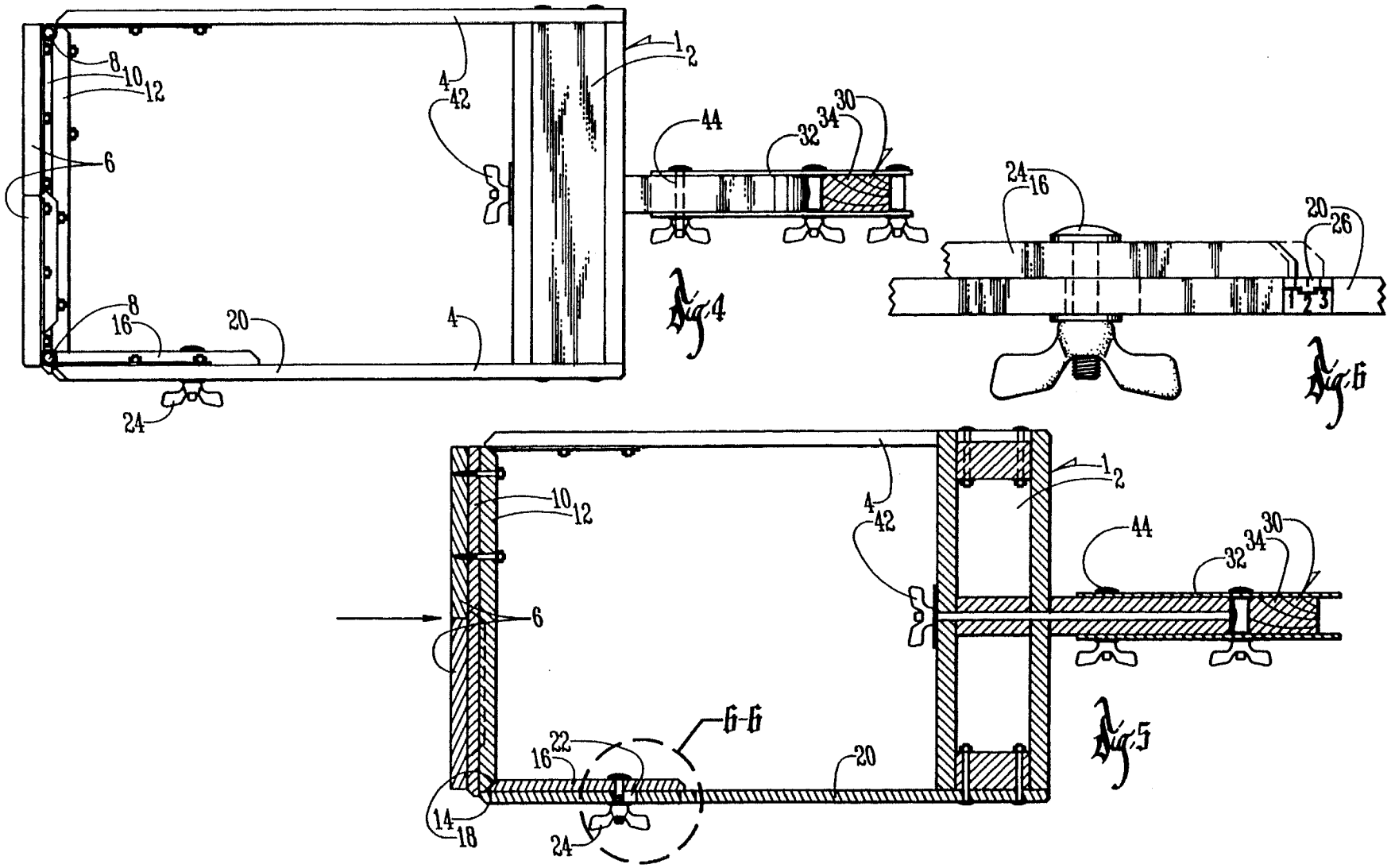
FIG. 4 is a top plan view along line 4—4 of FIG. 2.
FIG. 5 is a cross-sectional view along line 5—5 of FIG. 2.
FIG. 6 is an enlarged plan view within line 6—6 of FIG. 5.

When a real board is hit by a martial arts practitioner, the board will bend until it bends a sufficient distance at which time it will break in two. The present invention closely simulates the feel of a breaking board since the resistance piece 10 has to bend a certain distance before the assembly "breaks". The preferred embodiment of the present invention includes a means for adjusting the force required to break the assembly. As shown in FIGS. 5 and 6, the companion piece 16 is slidably coupled to the pressure release piece 20 so that the companion piece 16 can be moved in relation to pressure release piece 20. The pressure release piece 20 has an elongated hole 22 in which a fastener 24 is positioned through. When the companion piece 16 is moved to its desired position, the fastener 24 is tightened, securing companion piece 20 into place. As companion piece 16 is moved down towards the base 2, the space between the companion piece 18 and the breakaway piece 12 increases. As the space increases, the breakaway piece 12 has to move a farther distance before it pushes outward on the companion piece 16 and pressure release piece 20. Therefore, for the breakaway board assembly 1 to break, a greater force must be applied to the boards and the resistance piece 10 must be bent a farther distance.

The preferred embodiment includes a gauge 26 (FIG. 6) on pressure release piece 20 which has an indication of what position the companion piece 16 is in relative to the pressure release piece 20. The gauge 26 in the preferred embodiment includes the numbers 1, 2, and 3 corresponding to the positions of companion piece 16 which simulates the breaking of 1, 2, or 3 boards.

Please note that the breakaway board assembly 1 can take other forms or embodiments without departing from the spirit or scope of the present invention. For example, the boards 6 do not have to be attached to two pairs of opposing support members. The boards 6 only need to be supported in the first position and be moveable to the second position. Also, the locking mechanism could take many forms. The resistance piece 10 does not have to be coupled to one of the boards 6. Likewise, the breakaway piece 12 does not have to be positioned on the underside of the resistance piece 10 as shown in the figures. For example, the breakaway piece 12 could be positioned along side the resistance piece, or could be an integral part of the resistance piece 10. The pressure release piece 20 can also take many forms. The pressure release piece does not have to extend from the base as shown in the figures. The pressure release piece 20 could be attached to the support members 4 or could even be attached to one of the boards 6. The companion piece 16 can also take many forms. For example, the companion piece 16 could be formed in the pressure release piece 20. In the preferred embodiment, the boards 6, the resistance piece 10, the pressure release piece 20, the breakaway piece 12 and the companion piece 16 are comprised of wood. However, all these parts could be made from other materials. These alternatives are only a few of many alternatives or modifications within the scope of this invention.

Figure 3:
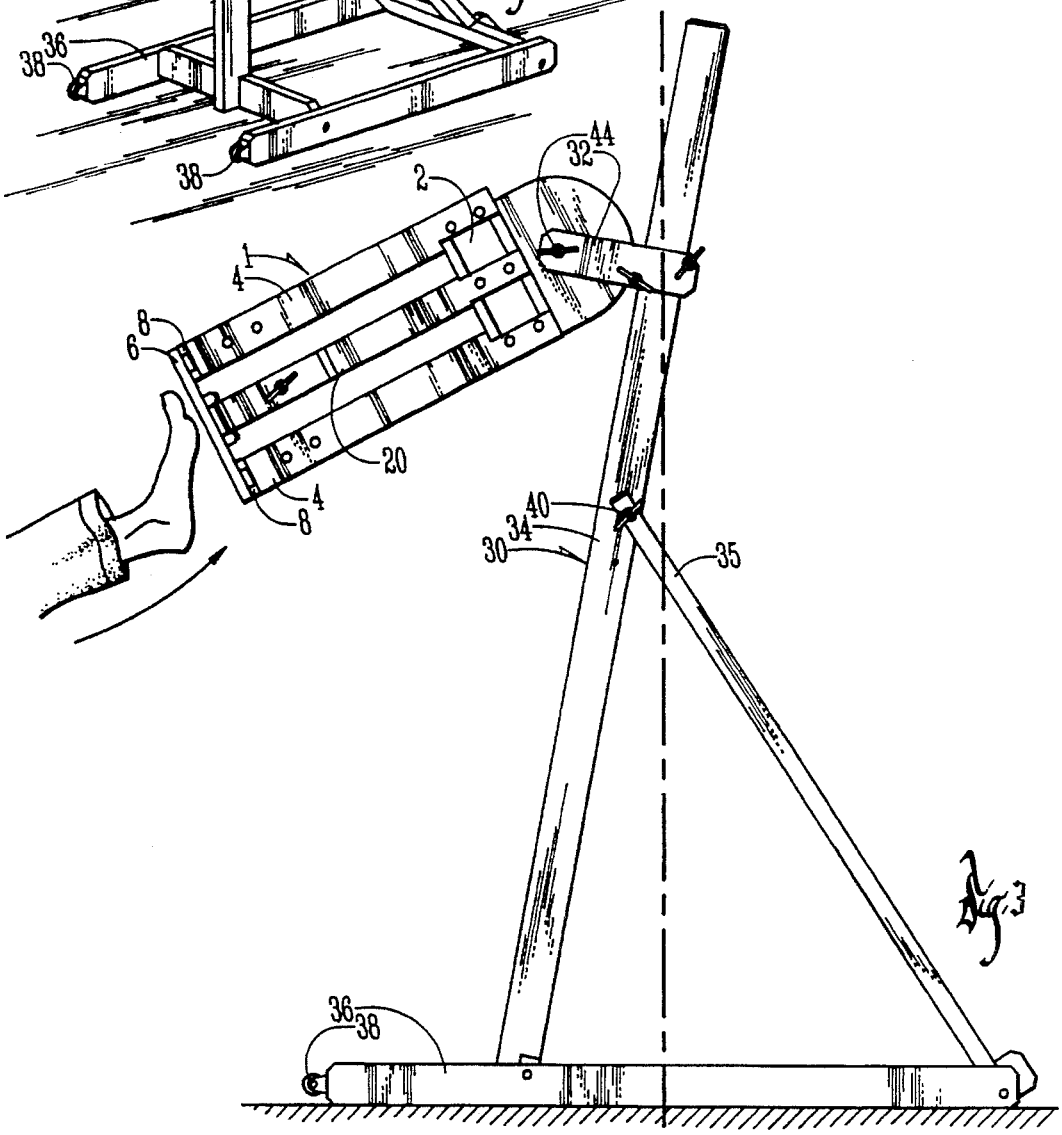
FIG. 3 is a side elevation view of the assembly in position for a snap kick.
Figure 10:
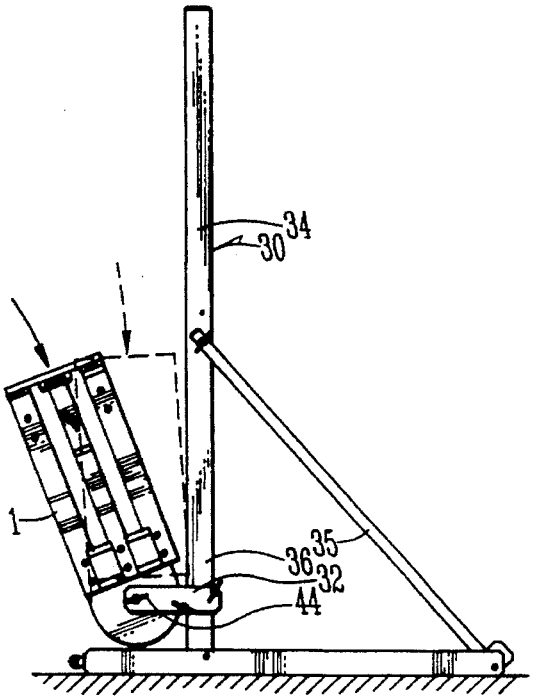
FIG. 10 shows an alternative position for the assembly for an ax kick (solid lines) or a knife hand (broken lines).
Figure 11:
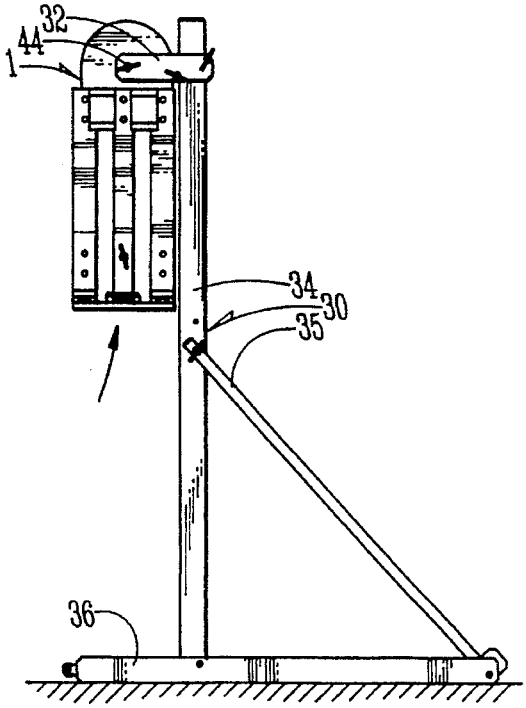
FIG. 11 shows an alternative position for a ridge hand.

The present invention can include a stand 30 which supports the breakaway board assembly 1 in a plurality of positions. The stand includes a stand base 36, a vertical member 34, and a diagonal member 35. As shown in FIG. 3, the breakaway board assembly 1 is slidably coupled to vertical member 34 through use of vertical mounting means 32 which allows the assembly 1 to adjust up and down vertical member 34 as shown in FIG. 3. The stand 30 also allows the breakaway board assembly 1 to rotate through rotatable mounting means 42 as shown in FIG. 5. As shown in FIG. 3, the assembly 1 can also pivotally adjust through the pivotal mounting means 44. In addition, vertical member 34 can be adjusted from a vertical position to an angled position by moving diagonal member 35. As can be seen in the figures, the stand 30 allows the breakaway board assembly 1 to be positioned in a plurality of configurations. For example, the breakaway board assembly can be positioned for a snap kick as shown in FIG. 3. In FIG. 10, the breakaway board assembly 1 is positioned for an ax kick (solid lines) or a knife hand (broken lines). FIG. 11 shows the breakaway board assembly 1 positioned for a ridge hand.

Figure 12:
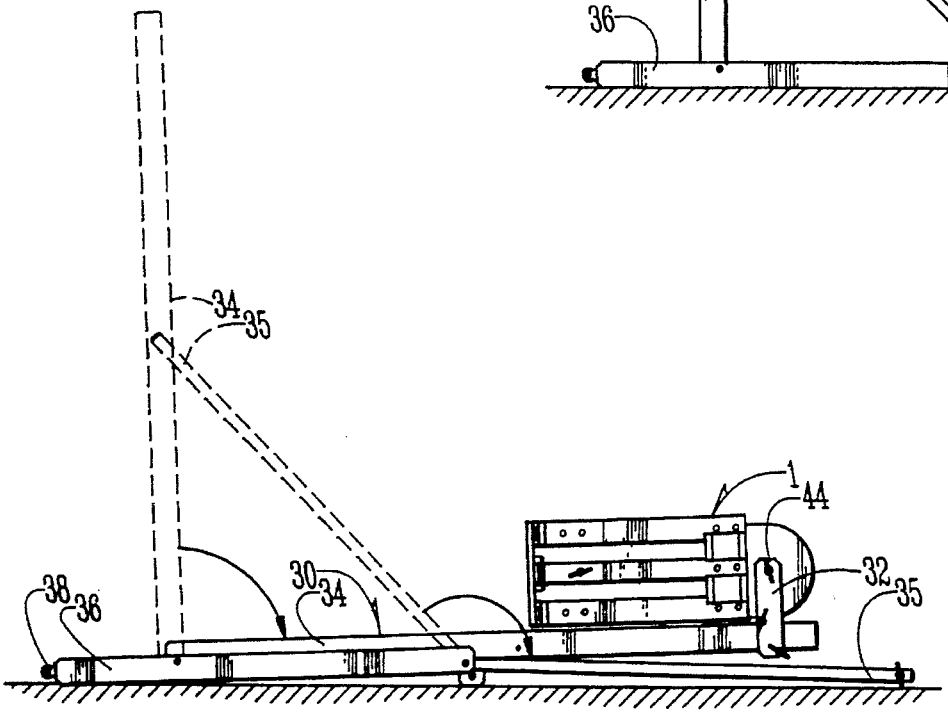
FIG. 12 is a side elevation of the assembly showing the structure altered to transport mode.
Figure 13:
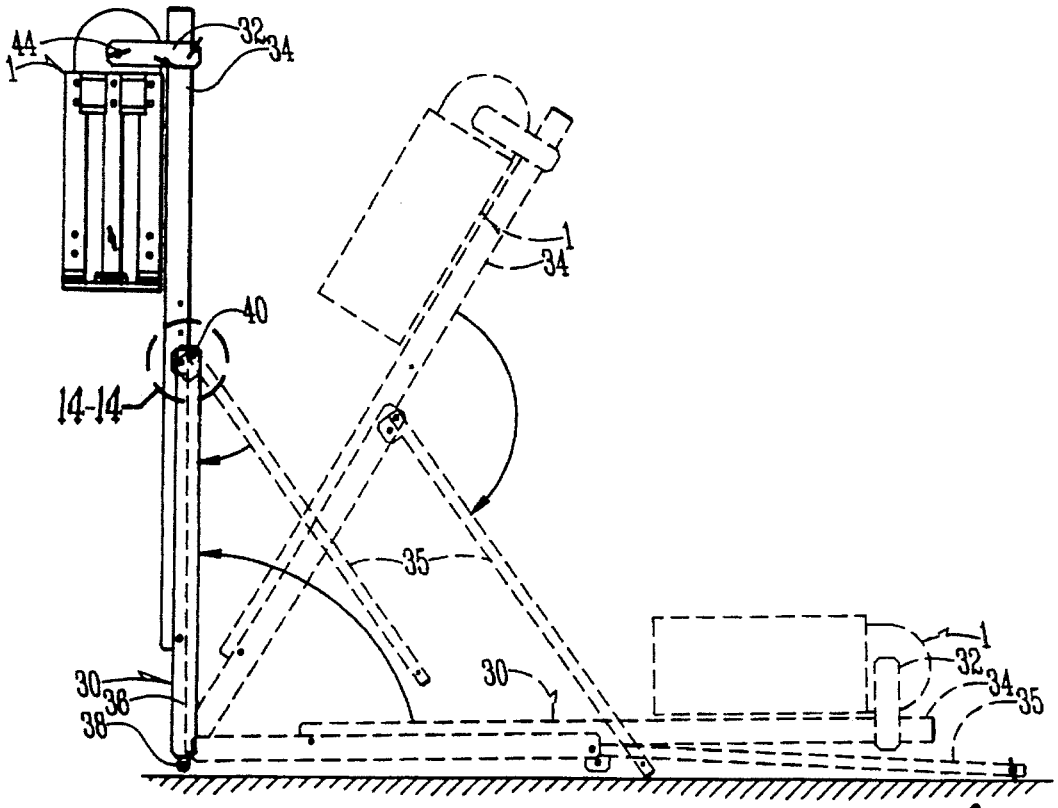
FIG. 13 is a side elevation showing the structure altered to transport mode.
Figure 14:
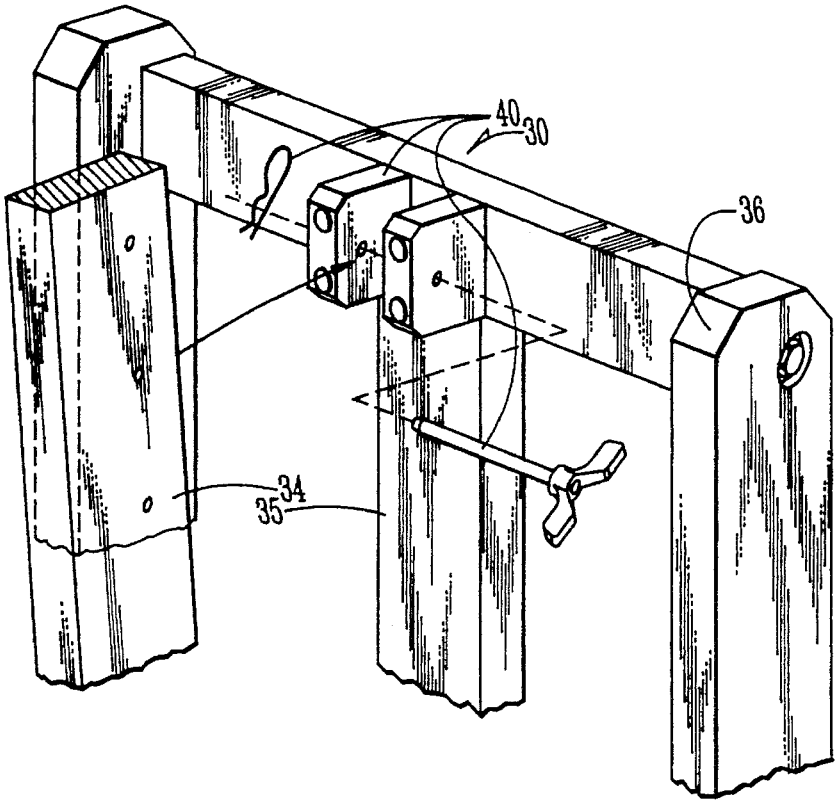
FIG. 14 is an enlarged isometric view of the locking mechanism for transport mode within line 14—14 of FIG. 13.

The stand 30 can also be configured to facilitate storage or transportation. FIG. 12 shows a side elevation of the present invention configured for the transport mode. The stand 30 also includes wheels 38 connected to the stand base 36 for easy transportation of the device. FIG. 13 shows the stand folded for transportation using wheels 38. When positioned in this configuration, the vertical member 34 can be secured to the stand base 36 through the locking mechanism 40 as shown in FIG. 14.

What is claimed is:

1. A reusable breakaway board assembly comprising:

a base;

first and second opposing support members coupled to said base, each of said opposing support members extending generally perpendicular from said base;

first and second boards, each of said boards having first and second ends, said first end of said first board movably coupled to said first support member, said first end of said second board movably coupled to said second support member, each of said boards being movable between a first position and a second position, said second end of each of said boards being proximate each other in a generally coplanar relationship when said first and second boards are in said first position, said first and second boards being generally parallel to said support members when in said second position;

a resistance piece, said resistance piece coupled to said first board, said resistance piece extending along said first and second boards while said boards are in said first position;

a breakaway piece coupled to said first board, said breakaway piece extending along said resistance piece;

a pressure release piece coupled to said base, said pressure release piece extending generally parallel to said second support member, said pressure release piece having a first end making contact with and supporting said resistance piece when said boards are in said first position;

a companion piece coupled to said pressure release piece, said companion piece having a beveled edge proximate said first end of said pressure release piece;

whereby said resistance piece will bend when a force is applied to said first or second boards causing said breakaway piece to slide along said beveled edge of said companion piece pushing said companion piece and pressure release piece outwardly until said resistance piece is free from said first end of said pressure release piece allowing said boards to move to said second position.

2. The reusable breakaway board assembly of claim 1 wherein said companion piece is slidably coupled to said pressure release piece making the force required to move said boards from said first position to said second position adjustable.

3. The breakaway board assembly of claim 2 further comprising an indicator proximate said companion piece corresponding to the selected position of said companion piece.

4. The reusable breakaway board assembly of claim 1 wherein an end of said breakaway piece is beveled.

5. The reusable breakaway board assembly of claim 1 wherein said companion piece is integral to said pressure release piece.

6. The reusable breakaway board assembly of claim 1 wherein said boards are movably coupled to said support members via hinges.

7. The reusable breakaway board assembly of claim 1 further comprising a stand coupled to said base.

8. The reusable breakaway board assembly of claim 7 wherein said assembly can be supported by said stand in a plurality of positions.

9. The reusable breakaway board assembly of claim 7, said stand comprising:

a stand base; and a vertical member pivotally coupled to said stand base, said vertical member movable between a position generally perpendicular to said stand base and generally parallel to said stand base, said base of said reusable breakaway board assembly being pivotally, rotatably and slidably coupled to said vertical member thereby allowing said assembly to be positioned in a plurality of positions.

10. The reusable breakaway board assembly of claim 7 wherein said stand includes at least two wheels for transporting said stand.

11. A reusable breakaway board assembly comprising:

first and second supporting members;

first and second boards, each of said boards having first and second ends, said first end of said first board being supported by said first supporting member, said first end of said second board being supported by said second support member;

a pressure release piece, said pressure release piece disposed proximate said second supporting member;

a resistance piece, said resistance piece supporting said second ends of said first and second boards, said resistance piece being disposed in a generally parallel relation to said first and second boards, said resistance piece making contact with said pressure release piece thereby being supported at one end by said pressure release piece; and a breakaway piece, said breakaway piece disposed proximate and generally parallel to said resistance piece;

whereby said breakaway piece deflects when a force is applied to said first and second boards causing said pressure release piece to lose contact with said resistance piece, thereby making said first and second boards collapse.

* * * * *